US007381885B2

(12) United States Patent
Arimoto

(10) Patent No.: US 7,381,885 B2
(45) Date of Patent: Jun. 3, 2008

(54) ELECTRONIC PERCUSSION INSTRUMENT AND PERCUSSION TONE CONTROL PROGRAM

(75) Inventor: Keita Arimoto, Hamamatsu (JP)

(73) Assignee: Yamaha Corporation, Hammatsu-Shi (JP)

( * ) Notice: Subject to any disclaimer, the term of this patent is extended or adjusted under 35 U.S.C. 154(b) by 509 days.

(21) Appl. No.: 11/181,185

(22) Filed: Jul. 13, 2005

(65) Prior Publication Data

US 2006/0011050 A1 Jan. 19, 2006

(30) Foreign Application Priority Data

Jul. 14, 2004 (JP) ..... 2004-207461
Jul. 14, 2004 (JP) ..... 2004-207465

(51) Int. Cl.
*G10H 1/02* (2006.01)
*G10H 1/18* (2006.01)
*G10H 3/00* (2006.01)
*G10H 3/12* (2006.01)

(52) U.S. Cl. ..... 84/737; 84/723; 84/738; 84/742

(58) Field of Classification Search ..... 84/737, 84/738, 742, 723
See application file for complete search history.

(56) References Cited

U.S. PATENT DOCUMENTS 3,378,625 A * 4/1968 Hurvitz ..... 84/601
3,763,305 A * 10/1973 Nakada et al. ..... 84/713
4,279,188 A * 7/1981 Scott ..... 84/723
4,781,097 A * 11/1988 Uchiyama et al. ..... 84/738
5,009,146 A * 4/1991 Manabe et al. ..... 84/615
5,223,654 A * 6/1993 Fujita ..... 84/627
5,280,742 A * 1/1994 Vergara ..... 84/411 R
5,288,938 A * 2/1994 Wheaton ..... 84/600
5,399,801 A * 3/1995 Hasebe et al. ..... 84/622

(Continued)

FOREIGN PATENT DOCUMENTS

JP H05-080754 4/1993

(Continued)

*Primary Examiner*—Lincoln Donovan
*Assistant Examiner*—Christina Russell
(74) *Attorney, Agent, or Firm*—Morrison & Foerster LLP

(57) ABSTRACT

An electronic percussion instrument which is capable of accurately discriminating roll performance to thereby electronically produce percussion tones closer to tones produced by a natural percussion instrument. A waveform memory 6 stores waveform data of percussion tones to be output for roll performance and waveform data of percussion tones to be output for non-roll performance. A work memory 4 stores values of parameters. A drum pad 1 has a percussion surface part 10, and a percussion pattern-detecting section detects a pattern of percussion applied to the percussion surface part 10 of the drum pad 1 and outputs a value of the parameter indicative of the detected pattern of percussion. The values of the parameter output from the percussion pattern-detecting section are sequentially stored in a buffer area of the work memory 4 in the order of output. Whenever a new value of the parameter is stored in the buffer area, a waveform data-determining section determines one of the two waveform data stored in the waveform memory 6 according to at least two values of the parameter stored before the new value of the parameter was stored and the new value of the parameter. A tone generation controller 7 reads out the determined waveform data from the waveform memory 6 and outputs a musical tone signal generated based on the read-out waveform data.

13 Claims, 7 Drawing Sheets

U.S. PATENT DOCUMENTS 5,920,026 A * 7/1999 Yoshino et al. ..... 84/738
6,005,181 A * 12/1999 Adams et al. ..... 84/734
6,031,176 A * 2/2000 Tanaka ..... 84/735
6,121,538 A * 9/2000 Yoshino et al. ..... 84/738
6,271,458 B1 * 8/2001 Yoshino et al. ..... 84/738
6,576,829 B1 * 6/2003 Hart ..... 84/737
6,753,467 B2 * 6/2004 Tanaka et al. ..... 84/723
7,078,610 B2 * 7/2006 Mori et al. ..... 84/735
7,112,739 B2 * 9/2006 Mori et al. ..... 84/737
7,135,637 B2 * 11/2006 Nishitani et al. ..... 84/723
2002/0112593 A1 * 8/2002 Yanase ..... 84/411 P
2003/0209132 A1 * 11/2003 Mishima ..... 84/730
2004/0149120 A1 * 8/2004 Maruhashi et al. ..... 84/411 R
2004/0255764 A1 * 12/2004 Mori et al. ..... 84/742
2004/0255765 A1 * 12/2004 Mori et al. ..... 84/742

FOREIGN PATENT DOCUMENTS

JP H05-100680 4/1993

* cited by examiner

ELECTRONIC PERCUSSION INSTRUMENT AND PERCUSSION TONE CONTROL PROGRAM

BACKGROUND OF THE INVENTION

1. Field of the Invention

The present invention relates to an electronic percussion instrument and a percussion tone control program, and more particularly to an electronic percussion instrument and a percussion tone control program that optimize generation of percussion tones for roll performance.

2. Description of the Related Art

Conventionally, there have been proposed various techniques for optimally dressing musical tones electronically produced by an electronic percussion instrument, or more specifically, various techniques for approximating percussion tones electronically produced by an electronic percussion instrument to percussion tones acoustically produced by a natural percussion instrument.

Japanese Laid-Open Patent Publication (Kokai) No. H05-80754 discloses an electronic percussion instrument which is capable of automatically applying sound effects to enhance a performer's expressive power. According to the publication, when it is detected that tone generation instruction information responsive to percussion applied to a drum pad has been consecutively given within a predetermined time period, the electronic percussion instrument adds a predetermined sounding effect, such as pan, to a musical tone signal generated in response to the tone generation instruction information.

Japanese Laid-Open Patent Publication (Kokai) No. H05-100680 discloses a technique for optimizing generation of musical tones (percussion tones) during repeated beating performance by an electronic percussion instrument. The electronic percussion instrument described in the publication stores a pair of waveform data for normal performance and waveform data for repeated beating performance, on a pad-by-pad basis. When a beat is applied to one pad, a time interval between the beat and an immediately preceding beat applied to the pad is detected, and if the detected time interval is shorter than a predetermined value, a musical tone signal indicative of the associated percussion tone is generated using the waveform data for repeated beating performance. More specifically, the electronic percussion instrument stores two types of waveform data as a pair on a pad-by-pad basis, and when percussion is applied to one pad within a predetermined time period, waveform data used for producing a musical tone signal for each beat is switched between one beat and the following beat, as deemed appropriate.

Performance methods realized by repeatedly beating a percussion instrument include flam performance and roll performance. In flam performance, a single beat by each of left and right sticks is applied with a short stroke, whereas in roll performance, a plurality of short-stroke beats by each of the left and right sticks are consecutively applied over a certain time period. When a natural percussion instrument is played according to these two performance methods, a clear difference in tone color appears between the percussion tones produced by the respective performance methods. Therefore, to approximate a percussion tone electronically produced by an electronic percussion instrument to a percussion tone acoustically produced by a natural percussion instrument, it is desirable that roll performance and flam performance should be accurately distinguished from each other such that a specific musical tone signal can be generated by each of the performance methods.

However, in the technique described in Japanese Laid-Open Patent Publication (Kokai) No. H05-100680, one of the two types of waveform data is selectively used only based on whether or not a time interval between two consecutive beats is shorter than a predetermined value, and hence it is impossible to distinguish roll performance from flam performance for which waveform data different from that used for roll performance should preferably be used.

Further, in the conventional electronic percussion instrument in which switching of waveform data is performed only based on whether a time interval from an immediately preceding beat is within a predetermined value, when application of a beat within the predetermined time interval from an immediately preceding beat occurs a plurality of consecutive times, musical tone signals in a number corresponding to that of the succeeding beats are simply generated based on the same waveform data, which can give an impression that the performance is monotonous.

SUMMARY OF THE INVENTION

It is a first object of the present invention to provide an electronic percussion instrument and a percussion tone control program which are capable of accurately discriminating roll performance to thereby electronically produce percussion tones closer to tones produced by a natural percussion instrument.

It is a second object of the present invention to provide an electronic percussion instrument and a percussion tone control program which are capable of avoiding monotony that occurs during roll performance, to thereby electronically produce percussion tones closer to tones produced by a natural percussion instrument.

To attain the above first object, in a first aspect of the present invention, there is provided an electronic percussion instrument comprising a waveform data storage device that stores waveform data of percussion tones to be output for roll performance and waveform data of percussion tones to be output for non-roll performance, a performance operator that has a percussion surface, a percussion pattern-detecting device that detects a pattern of percussion applied to the percussion surface of the performance operator, and outputs a value of a parameter indicative of the detected pattern of percussion, a parameter storage device that stores values of the parameter, a storage control device that causes values of the parameter output from the percussion pattern-detecting device to be sequentially stored in the parameter storage device in an order of output, a waveform data-determining device that is operable when a new value of the parameter is stored in the parameter storage device, to determine one of the two waveform data stored in the waveform data storage device according to at least two values of the parameter stored before the new value of the parameter was stored and the new value of the parameter, and a musical tone signal output device that reads out the determined waveform data from the waveform data storage device, and outputs a musical tone signal generated based on the read-out waveform data.

With the configuration of the electronic percussion instrument according to the first aspect of the present invention, a pattern of percussion applied to a percussion surface is detected, and values of a parameter indicative of the detected percussion pattern are sequentially stored. During this operation, whenever a new beat is applied, a plurality of values of the parameter stored before the application of the beat are referred to so as to determine whether or not roll performance is being executed. This method makes it possible to discriminate between roll performance and flam performance with high accuracy.

Preferably, the detected pattern of percussion is a beat-to-beat time interval, a degree of beat intensity, a displacement amount of a beat position on the percussion surface, or a combination of at least two thereof.

Preferably, the percussion pattern-detecting device is operable when a beat is applied to the percussion surface, to detect a time interval between the beat and an immediately preceding beat as the pattern of percussion, and output a value of a parameter indicative of the detected time interval as the value of the parameter, and the waveform data-determining device is operable when a time interval indicated by a new value of the parameter stored in the parameter storage device and time intervals indicated by at least two values of the parameter stored before the new value of the parameter was stored are all shorter than a predetermined value, to determine the waveform data of percussion tones to be output for roll performance, from the two waveform data stored in the waveform data storage device.

More preferably, the percussion pattern-detecting device detects beat intensity of the beat applied to the percussion surface and the time interval, and outputs values of respective parameters indicative of the detected beat intensity and the detected time interval, and the waveform data-determining device is operable when the time interval indicated by the new value of the parameter indicative thereof stored in the parameter storage device and the time intervals indicated by the at least two values of the parameter indicative thereof stored before the new value of the parameter indicative thereof was stored are all shorter than the predetermined value, and a degree of beat intensity indicated by a new value of the parameter indicative thereof is smaller than a predetermined value, to determine the waveform data of percussion tones to be output for roll performance.

Preferably, the percussion pattern-detecting device is operable when a beat is applied to the percussion surface, to detect a time interval between the beat and an immediately preceding beat as the pattern of percussion, and output a value of a parameter indicative of the detected time interval as the value of the parameter, and the waveform data-determining device is operable when an average value of the time interval indicated by a new value of the parameter indicative thereof stored in the parameter storage device and time intervals indicated by at least two values of the parameter indicative thereof stored before the new value of the parameter indicative thereof was stored is smaller than a predetermined value, to determine the waveform data of percussion tones to be output for roll performance, from the two waveform data stored in the waveform data storage device.

More preferably, the percussion pattern-detecting device detects beat intensity of the beat applied to the percussion surface and the time interval, and outputs values of respective parameters indicative of the detected beat intensity and the detected time interval, and the waveform data-determining device is operable when the average value of the time interval indicated by the new value of the parameter indicative thereof stored in the parameter storage device and the time intervals indicated by the at least two values of the parameter indicative thereof stored before the new value of the parameter was stored is smaller than the predetermined value and a degree of beat intensity indicated by a new value of the parameter indicative thereof is smaller than a predetermined value, to determine the waveform data of percussion tones to be output for roll performance.

Preferably, the percussion pattern-detecting device is operable when a beat is applied to the percussion surface, to detect beat intensity of the beat as the pattern of percussion, and output a value of a parameter indicative of the detected beat intensity as the value of the parameter, and the waveform data-determining device is operable when a degree of beat intensity indicated by a new value of the parameter indicative thereof stored in the parameter storage device and degrees of beat intensity indicated by the at least two values of the parameter indicative thereof stored before the new value of the parameter indicative thereof was stored are all smaller than a predetermined value, to determine the waveform data of percussion tones to be output for roll performance, from the two waveform data stored in the waveform data storage device.

Preferably, the percussion pattern-detecting device is operable when a beat is applied to the percussion surface, to detect appositional displacement amount between a position where the beat was applied and a position where an immediately preceding beat was applied, as the pattern of percussion, and output a parameter indicative of the detected positional displacement amount, and the waveform data-determining device is operable when a positional displacement amount indicated by a new value of the parameter indicative thereof stored in the parameter storage device and positional displacement amounts indicated by at least two values of the parameter indicative thereof stored before the new value of the parameter indicative thereof was stored are all smaller than a predetermined value, to determine the waveform data of percussion tones to be output for roll performance, from the two waveform data stored in the waveform data storage device.

To attain the above second object, in a second aspect of the present invention, there is provided an electronic percussion instrument comprising a storage device that stores a plurality of waveform data obtained by applying percussion to a percussion instrument, and stores a plurality of waveform data analogous to each other in association with beats determined as equal to each other, a performance operator that has a percussion surface, a detecting device that detects a beat applied to the percussion surface of the performance operator, and outputs a beat detection signal indicative of the detected beat, a determining device that determines a pattern of percussion based on the beat detection signal, a waveform reading device that reads out waveform data associated with the pattern determined by the determining device, from the storage device, the waveform reading device being operable when percussion of a certain pattern is detected, to read out waveform data selected in accordance with a predetermined algorithm from a plurality of waveform data associated with beats equal to each other, corresponding to the detected pattern, a musical tone-generating device that generates a musical tone signal based on the read-out waveform data, and outputs the generated musical tone signal, and a switching control device that switches waveform data to be read out by the waveform reading device whenever the beat detection signal is output.

With the configuration of the electronic percussion instrument according to the second aspect of the present invention, in the case where a series of beat detection signals indicative of beats determined as equal to each other in percussion of a certain pattern are consecutively input, the musical tone signal for the percussion tones is generated while switching a plurality of waveform data analogous to each other. Therefore, even when beats equal in the input pattern are consecutively applied with short strokes, it is possible to avoid repeated output of quite the same musical tone signal, so that it is possible to sound percussion tones giving no impression of monotony.

Preferably, the detected pattern of percussion is beat intensity, a beat-to-beat time interval, a beat position on the percussion surface, a time period of contact with the percussion surface, or a combination of at least two thereof.

More preferably, the switching control device generates a random number in accordance with a predetermined random number generation algorithm, and switches the waveform data to be read out by the waveform reading device, according to the generated random number.

To attain the above first object, in a third aspect of the present invention, there is provided a program readable by a computer including a waveform data storage device that stores waveform data of percussion tones to be output for roll performance and waveform data of percussion tones to be output for non-roll performance, an input device that inputs a parameter indicative of a pattern of percussion applied to a percussion instrument, a parameter storage device that stores values of the parameter, and an output device that outputs a musical tone signal, comprising a storage control module for causing values of the parameter input via the input device to be sequentially stored in the parameter storage device in an order of input, a waveform data-determining module that is operable when a new value of the parameter is stored in the parameter storage device, to determine one of the two waveform data stored in the waveform data storage device according to at least two values of the parameter stored before the new value of the parameter was stored and the new value of the parameter, and an output module for reading out the determined waveform data from the waveform data storage device, and outputting a musical tone signal generated based on the read-out waveform data.

With the configuration of the percussion tone control program according to the third aspect of the present invention, it is possible to obtain the same advantageous effects as provided by the percussion tone control apparatus according to the first aspect of the invention.

To attain the above second object, in a fourth aspect of the present invention, there is provided a program readable by a computer including a storage device that stores a plurality of waveform data obtained by applying percussion to a percussion instrument, and stores a plurality of waveform data analogous to each other in association with beats determined as equal to each other, an input device that inputs a beat detection signal indicative of a beat applied to a percussion instrument, and an output device that outputs a musical tone signal, comprising a determining module for determining a pattern of percussion based on the beat detection signal input via the input device, a waveform reading module for reading out waveform data associated with the pattern determined by the determining module, from the storage device, the waveform reading module being operable when percussion of a certain pattern is detected, to read out waveform data selected in accordance with a predetermined algorithm from a plurality of waveform data associated with beats equal to each other, corresponding to the detected pattern, a musical tone-generating module for generating the musical tone signal based on the read-out waveform data, and outputs the generated musical tone signal via the output device, and a switching control module for switching waveform data to be read out by the waveform reading device whenever the beat detection signal is output.

With the configuration of the percussion tone control program according to the fourth aspect of the present invention, it is possible to obtain the same advantageous effects as provided by the percussion tone control apparatus according to the second aspect of the invention.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

First, a description will be given of an electronic percussion instrument according to a first embodiment of the present invention.

Figure 1:
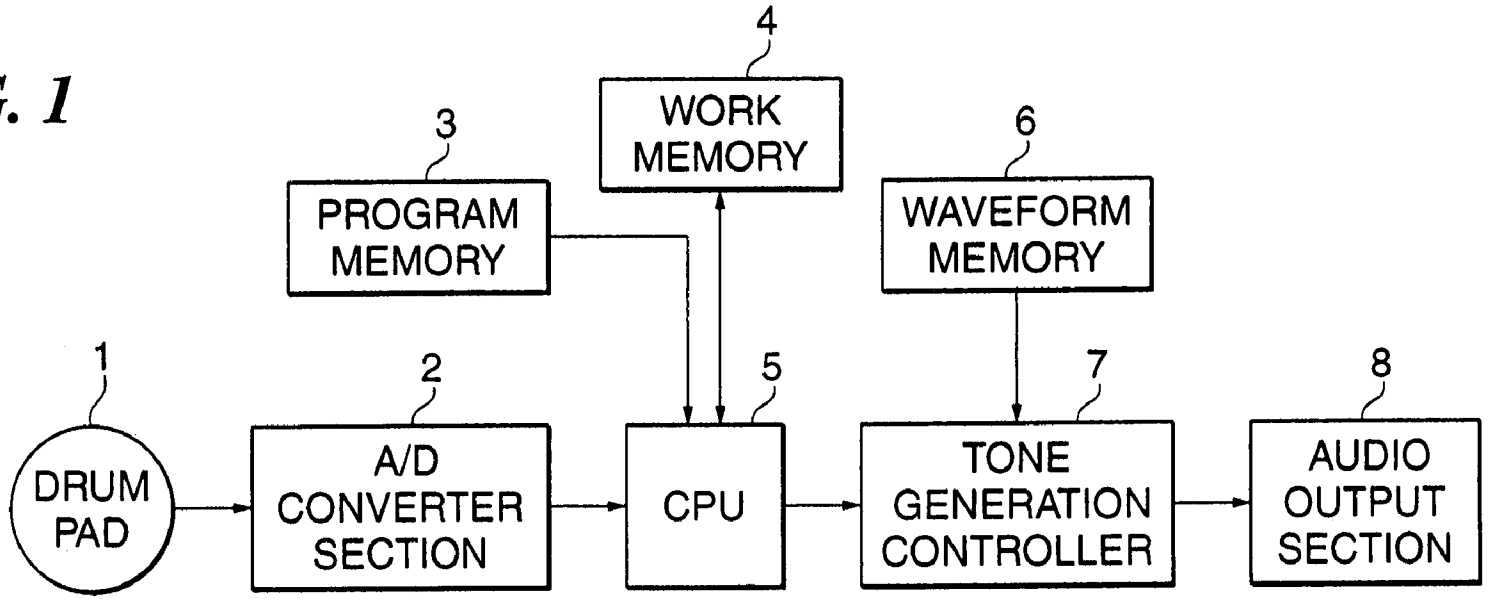
FIG. 1 is a block diagram showing the hardware configuration of an electronic percussion instrument according to a first embodiment of the present invention.

FIG. 1 is a block diagram showing the hardware configuration of the electronic percussion instrument according to the first embodiment.

As shown in FIG. 1, the electronic percussion instrument is comprised of a drum pad 1, an analog-to-digital (hereinafter referred to as "A/D") conversion section 2, a program memory 3, a work memory 4, a CPU 5, a waveform memory 6, a tone generation controller 7, and an audio output section 8.

Figure 2:
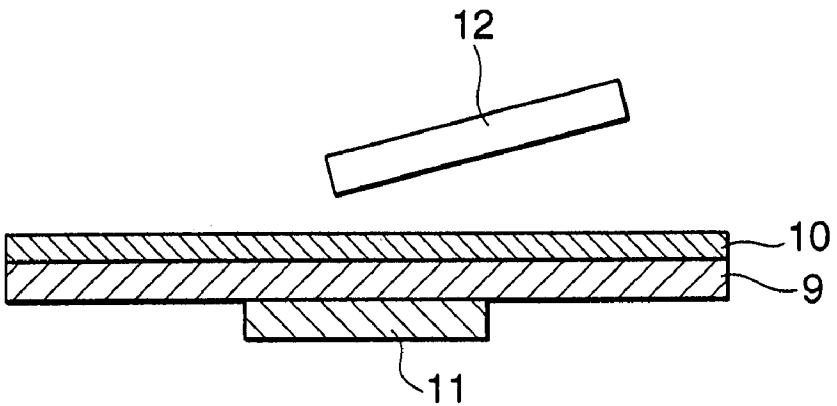
FIG. 2 is a view showing the structure of a drum pad appearing in FIG. 1.

The drum pad 1 functions as a performance operator, and as shown in FIG. 2, has a rubber percussion surface part 10 provided on an upper surface of a metal base part 9, and a vibration sensor 11 provided on a lower surface of the same. When a beat is applied to the percussion surface part 10 by a beating member 12, such as a stick, vibration caused by the beat is transmitted to the vibration sensor 11 via the base part 9, and an analog vibration detection signal having a level corresponding to the intensity of the beat applied to the percussion surface part 10 is output from the vibration sensor 11.

The vibration detection signal output from the vibration sensor 11 of the drum pad 1 is converted into digital data by the A/D conversion section 2, and the digital data is supplied to the CPU 5.

The waveform memory 6 stores two types of waveform data different in frequency characteristics. One of the waveform data is provided for roll performance, and the other for non-roll performance. The two waveform data are associated, respectively, with waveform codes for identifying the respective waveform data.

The program memory 3 stores in advance a specific program for causing the CPU 5 to carry out operations characteristic of the electronic percussion instrument according to the first embodiment. The CPU 5 executes the program stored in the program memory 3 by using the work memory 4, whereby two functional modules, i.e. a percussion pattern-detecting section and a waveform data-determining section are logically realized.

Now, a description will be given of the roles of the two functional modules. First, the percussion pattern-detecting section detects from the vibration detection signal a beat-to-beat time interval as one of factors characterizing the pattern of percussion applied to the drum pad 1, and outputs a value of a parameter Tdiff indicative of the detected beat-to-beat time interval.

The detection of the beat-to-beat time interval is performed as follows: When the vibration detection signal is supplied from the drum pad 1, first, the percussion pattern-detecting section generates timing data indicative of timing in which the signal was supplied. The work memory 4 has a timing data storage area allocated for temporarily storing timing data, and the generated timing data is stored in the timing data storage area until new timing data is generated. When new timing data is generated, the percussion pattern-detecting section obtains the difference between the new timing data and the timing data stored in the timing data storage area, to thereby detect the beat-to-beat time interval. Then, after outputting the value of the parameter Tdiff indicative of the detected beat-to-beat time interval, the percussion pattern-detecting section replaces the timing data stored in the timing data storage area with the new timing data.

The work memory 4 also has a buffer area allocated for storing values of the parameter Tdiff, and values of the parameter Tdiff output from the percussion pattern-detecting section are sequentially stored in the buffer area. When a new value of the parameter Tdiff is stored in the buffer area, the waveform data-determining section determines waveform data to be read from the waveform memory 6, based on the new value of the parameter Tdiff and a plurality of values of the parameter Tdiff stored in the buffer area before the new parameter Tdiff value was stored. Then, the waveform data-determining section outputs the waveform code associated with the determined waveform data to the tone generation controller 7, together with velocity data generated based on the vibration detection signal and pad-on data for instructing the tone generation controller 7 to generate a musical tone corresponding to the beat applied to the drum pad 1.

When a set of the waveform code, the velocity data, and the pad-on data is supplied from the waveform data-determining section, the tone generation controller 7 reads out the waveform data associated with the waveform code from the waveform memory 6. Then, the tone generation controller 7 adds envelope waveform data corresponding to the velocity data to the read-out waveform data, to thereby generate a musical tone signal. The audio output section 8 outputs a musical tone synthesized based on this musical tone signal.

Figure 3:
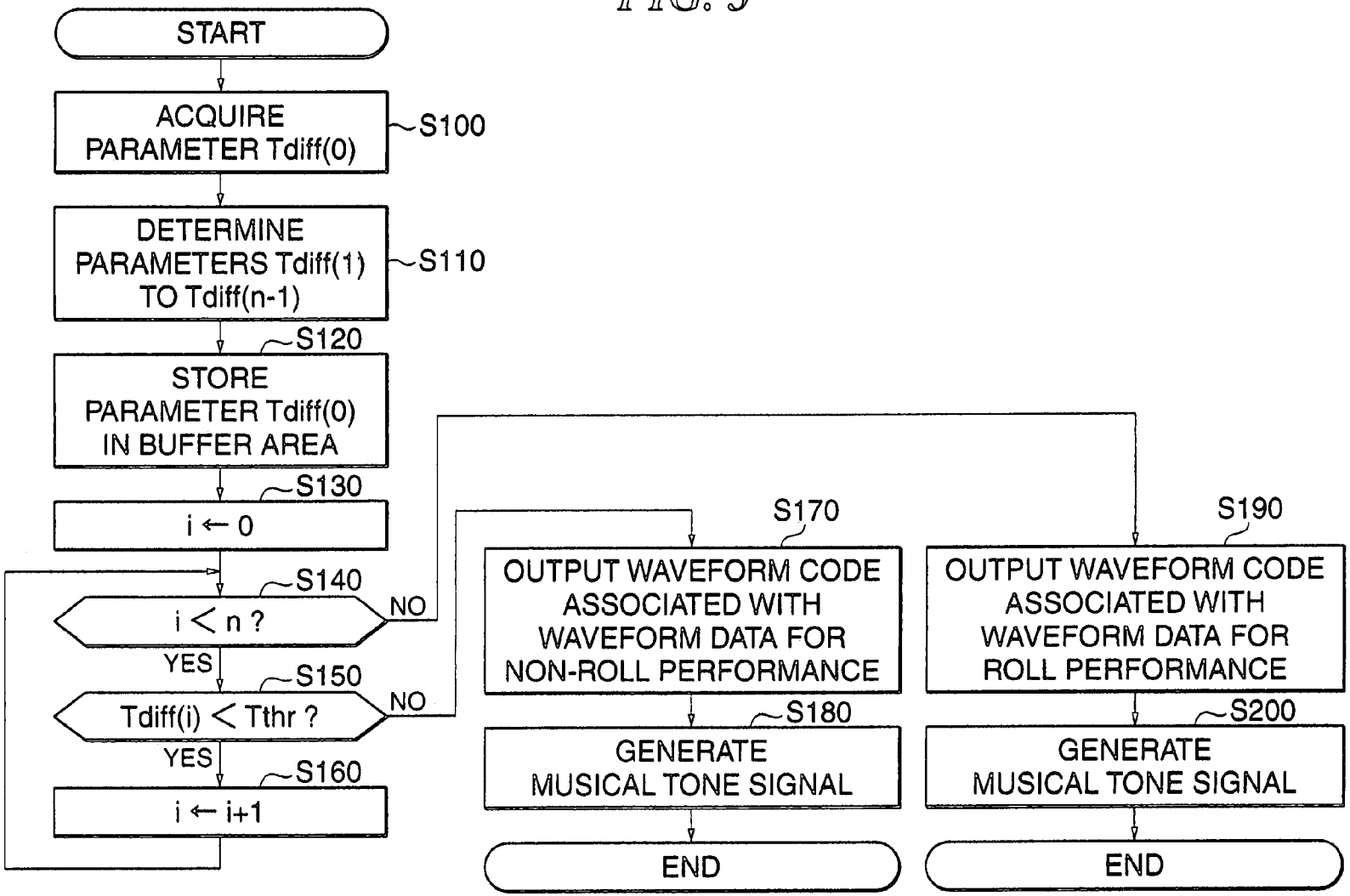
FIG. 3 is a flowchart showing the operation of the electronic percussion instrument in FIG. 1.

FIG. 3 is a flowchart showing the operation of the electronic percussion instrument in FIG. 1.

In FIG. 3, a suffix (i) attached to the parameter Tdiff is a variable representing a value of the parameter Tdiff indicative of the beat-to-beat time interval, and the suffix value i corresponds to a position of each parameter Tdiff value in the chronological sequence of the stored values. For example, a value of the parameter Tdiff (hereinafter referred to as "parameter Tdiff value") obtained from a value of the vibration detection signal associated with the newest beat is represented by Tdiff(0), and a parameter Tdiff value obtained from a value of the vibration detection signal associated with the immediately preceding beat by Tdiff(1). In the present flowchart, a constant n represents a predetermined number of times of reference to the parameter Tdiff. The constant n has to be a positive integer not less than 3.

In a step S100 in FIG. 3, first, the new parameter value Tdiff(0) is acquired from the percussion pattern-detecting section. In the next step S110, the waveform. data-determining section determines parameter values Tdiff(1) to Tdiff(n−1) to be referred to. Then, the process proceeds to a step S120, wherein the parameter value Tdiff(0) is stored in the buffer area.

In a step S130, "0" is input to the variable i. In the next step S140, it is determined whether or not a numerical value input to the variable i is smaller than the constant n.

If the answer to the question of the step S140 is affirmative (YES), the process proceeds to a step S150, wherein it is determined whether or not a beat-to-beat time interval represented by the parameter Tdiff(i) is shorter than a predetermined time interval Tthr preset as a threshold value. If the answer to the question of the step S150 is affirmative (YES), the process proceeds to a step S160. In the step S160, the value of the variable i is incremented by 1, followed by the process returning to the step S140. On the other hand, if the answer to the question of the step S150 is negative (NO), the process proceeds to a step S170, wherein processing for non-roll performance is executed. More specifically, the waveform code associated with the waveform data for non-roll performance is output together with velocity data and pad-on data. Then, in a step S180, the waveform data for non-roll performance is read out from the waveform memory 6, and a musical tone signal is generated based on the waveform data.

If the answer to the question of the step S140 is negative (NO), the process proceeds to a step S190, wherein processing for roll performance is executed. More specifically, the waveform code associated with the waveform data for roll performance is output together with velocity data and pad-on data. Then, in a step S200, the waveform data for roll performance is read out from the waveform memory 6, and a musical tone signal is generated based on the waveform data.

In the above-described electronic percussion instrument according to the first embodiment, parameter Tdiff values indicative of beat-to-beat time intervals of percussion applied to the drum pad 1 are sequentially stored in the buffer area. During this operation, when a beat is applied to the drum pad 1, n parameter Tdiff values, i.e. not less than three parameter Tdiff values including a new parameter Tdiff value obtained from the beat are sequentially referred to in reverse chronological order, and only when the beat-to-beat time intervals indicated by the respective parameter Tdiff values referred to are shorter than the predetermined time period, the musical tone signal for roll performance is generated. Therefore, it is possible to avoid an error that flam performance in which only a single beat by each of left and right sticks or the like is applied with a short stroke is determined as roll performance, to thereby detect percussion by roll performance with high accuracy.

Next, a description will be given of an electronic percussion instrument according to a second embodiment of the present invention.

As is distinct from the electronic percussion instrument according to the first embodiment in which whether or not roll performance is being executed is determined by referring to each of parameter Tdiff values stored in the buffer area, in the electronic percussion instrument according to the second embodiment, whether or not roll performance is being executed is determined based on the average value of beat-to-beat time intervals indicated by a plurality of parameter Tdiff values stored in the buffer area.

The electronic percussion instrument according to the second embodiment is identical in hardware configuration to the electronic percussion instrument according to the first embodiment, and therefore duplicate description thereof is omitted.

Figure 4:
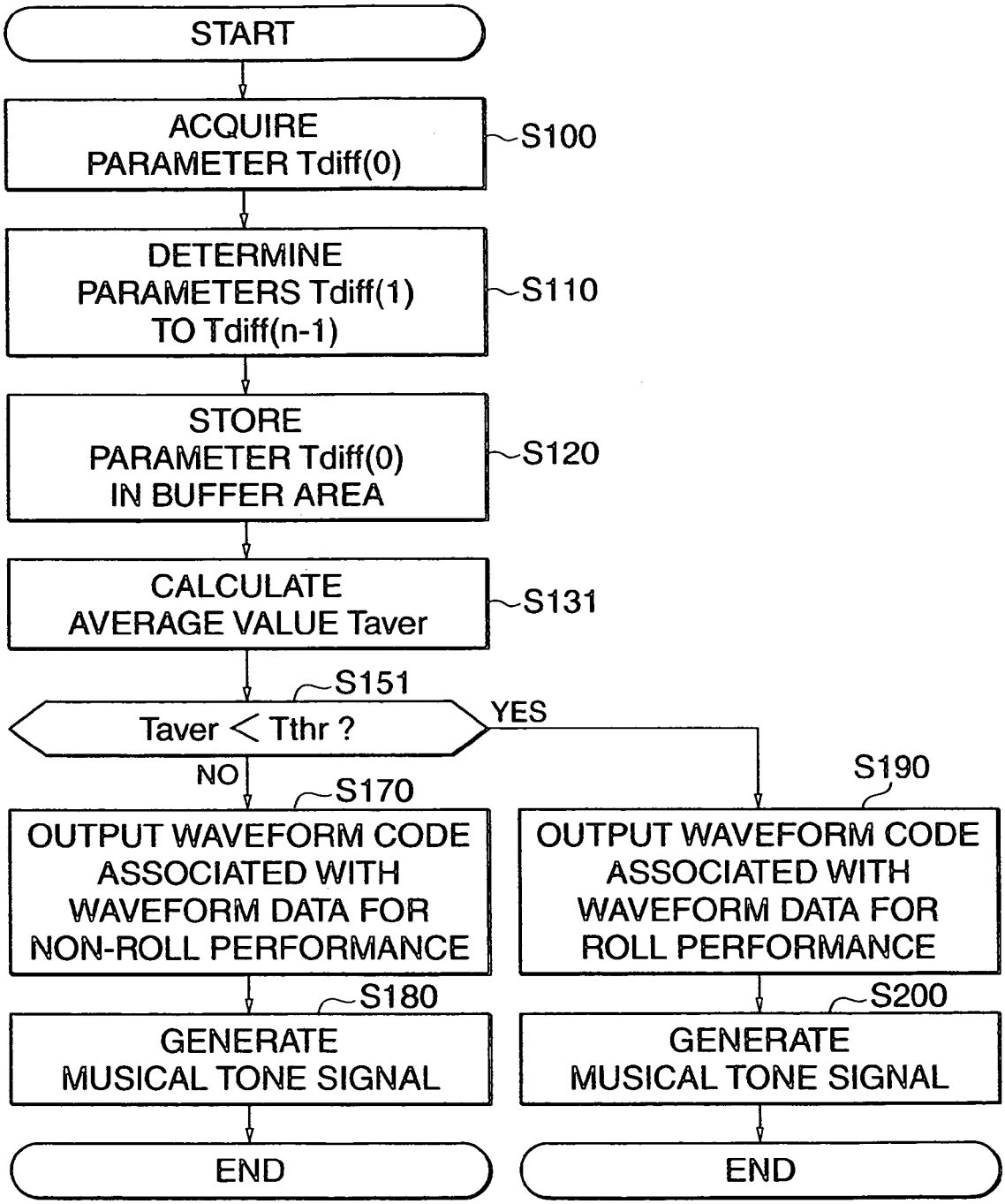
FIG. 4 is a flowchart showing the operation of an electronic percussion instrument according to a second embodiment of the present invention.

FIG. 4 is a flowchart showing the operation of the electronic percussion instrument according to the second embodiment.

Also in FIG. 4, the suffix (i) attached to the parameter Tdiff is a variable representing a value of the parameter Tdiff indicative of the beat-to-beat time interval, and the suffix value i corresponds to a position of each parameter Tdiff value in the chronological sequence of the stored values. Further, the constant n represents a predetermined number of times of reference to the parameter Tdiff, and has to be a positive integer not less than 3. Taver represents the average value of beat-to-beat time intervals indicated by n parameter Tdiff values Tdiff. Taver is calculated using the following equation:

$$\text{Taver} = \sum_{k=0}^{n-1} Tdiff\,(k)/n$$

In the procedure shown in FIG. 4, the steps S130 to S160 appearing in FIG. 3 are replaced by steps S131 and S151. More specifically, when a new parameter value Tdiff(0) is stored in the buffer area in the step S120, the process proceeds to the step S131, wherein the average value Taver of beat-to-beat time intervals is calculated using the above equation. In the next step S151, it is determined whether or not the beat-to-beat time interval represented by the average value Taver is shorter than a predetermined time interval Tthr preset as a threshold value. If the answer to the question of the step S151 is negative (NO), the processing for non-roll performance is executed (steps S170 and S180), whereas if the answer is affirmative (YES), the processing for roll performance is executed (steps S190 and S200).

In the electronic percussion instrument according to the second embodiment, the average value of beat-to-beat time intervals represented by n parameter Tdiff values, i.e. not less than three parameter Tdiff values is obtained, and when the beat-to-beat time interval represented by the obtained average value is shorter than the predetermined time period, the musical tone signal for roll performance is generated. This method also makes it possible to detect percussion by roll performance with high accuracy.

Next, a description will be given of an electronic percussion instrument according to a third embodiment of the present invention.

As is distinct from the electronic percussion instruments according to the first and second embodiments in which whether or not roll performance is being executed is determined based on the beat-to-beat time interval as one of factors characterizing the pattern of percussion, in the electronic percussion instrument according to the third embodiment, whether or not roll performance is being executed is determined based on beat intensity as another factor characterizing the pattern of percussion.

The electronic percussion instrument according to the third embodiment is identical in hardware configuration to the electronic percussion instruments of the first and second embodiments. In the electronic percussion instrument according to the third embodiment, when a vibration detection signal is supplied from the drum pad 1, the percussion pattern-detecting section implemented by the CPU 5 detects beat intensity from the vibration detection signal and outputs a value of a parameter indicative of the detected beat intensity.

Figure 5:
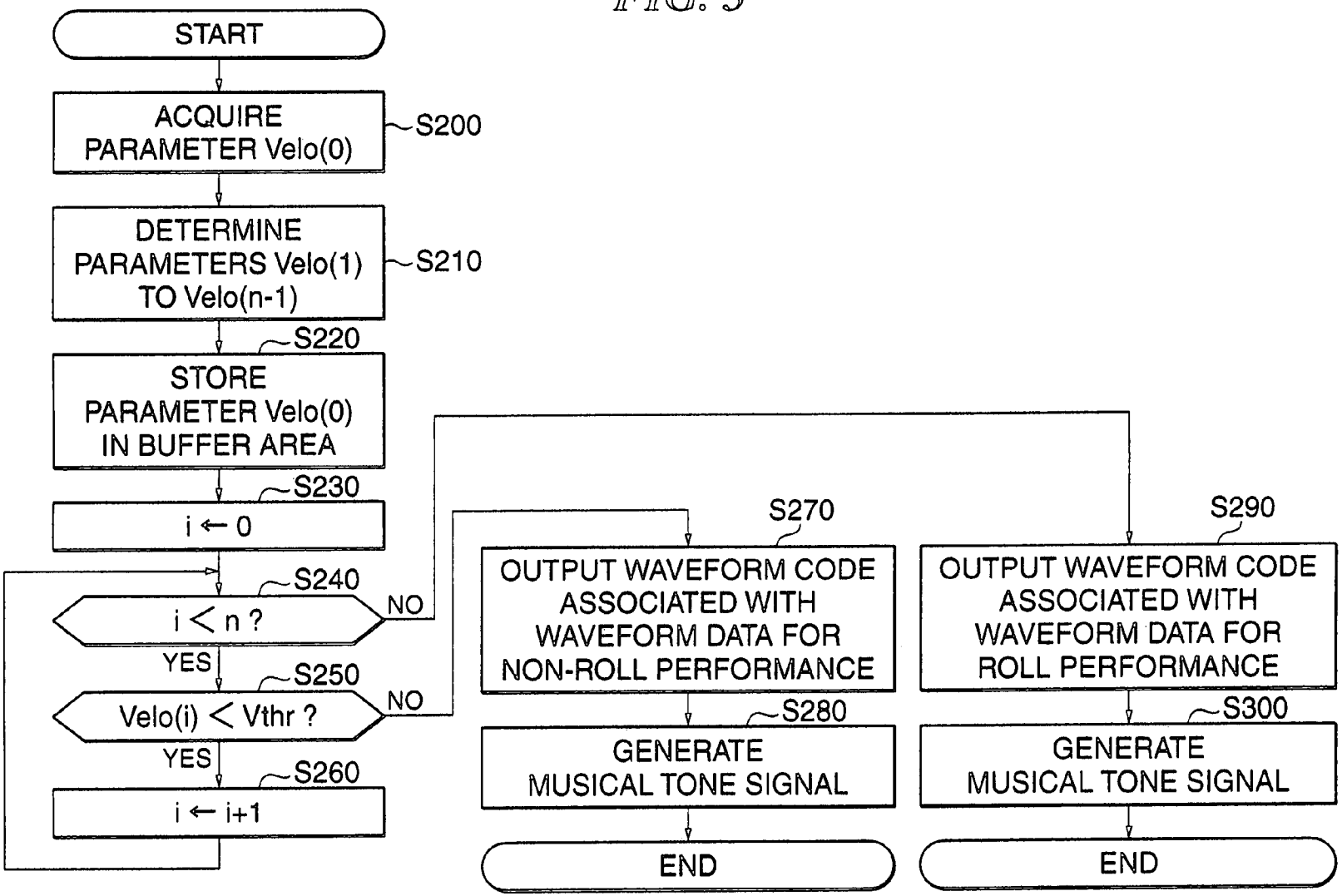
FIG. 5 is a flowchart showing the operation of an electronic percussion instrument according to a third embodiment of the present invention.

FIG. 5 is a flowchart showing the operation of the electronic percussion instrument according to the third embodiment.

In FIG. 5, Velo represents the parameter indicative of the beat intensity, and a suffix (i) attached to the parameter Velo is a variable representing a value of the parameter Velo. The suffix value i corresponds to a position of each parameter Velo value in the chronological sequence of the stored values. Further, the constant n represents a predetermined number of times of reference to the parameter Velo, and has to be a positive integer not less than 3.

Processing executed in steps S200 to S240 in FIG. 5 is similar to that in the steps S100 to S140 in FIG. 3 except that the parameter value used for the processing is a parameter value Velo(i).

If the answer to the question of the step S240 is affirmative (YES), the process proceeds to a step S250, wherein it is determined whether or not the beat intensity indicated by the parameter value Velo(i) is smaller than a predetermined value Vthr preset as a threshold value. If the answer to the question of the step S250 is affirmative (YES), the process proceeds to a step S260, wherein the value of the variable i is incremented by 1, followed by the process returning to the step S240.

On the other hand, if the answer to the question of the step S250 is negative (NO), the processing for non-roll performance is executed (steps S270 and S280).

If the answer to the question of the step S240 is negative (NO), the processing for roll performance is executed (steps S290 and S300).

In the above-described electronic percussion instrument according to the third embodiment, values of the parameter Velo indicative of the beat intensity are sequentially stored in the buffer area. During this operation, when a beat is applied to the drum pad 1, n parameter Velo values, i.e. not less than three parameter Velo values including a new parameter Velo value obtained from the beat are sequentially referred to in reverse chronological order, and only when degrees of the beat intensity indicated by the respective parameter Velo values referred to are smaller than the predetermined value, the musical tone signal for roll performance is generated. This method also makes it possible to detect percussion by roll performance with high accuracy.

Next, a description will be given of an electronic percussion instrument according to a fourth embodiment of the present invention.

As is distinct from the electronic percussion instruments according to the first to third embodiments in which whether or not roll performance is being executed is determined based on the beat-to-beat time interval or the beat intensity as one of factors characterizing the pattern of percussion, in the electronic percussion instrument according to the fourth embodiment, whether or not roll performance is being executed is determined based on the amount of displacement of a beat position as still another factor characterizing the pattern of percussion.

In the electronic percussion instrument according to the fourth embodiment, the drum pad 1 is different in hardware configuration from that of the electronic percussion instruments according to the first to third embodiments. In the electronic percussion instruments according to the first to third embodiments, the drum pad 1 has the single vibration sensor 11 disposed on the lower surface of the base part 9, whereas in the electronic percussion instrument according to the fourth embodiment, a plurality of vibration sensors 11 are provided on the lower surface of the base part 9 in a manner spaced apart by a predetermined distance.

When the beating member 12 applies a beat to the percussion surface part 10 of the drum pad 1 constructed as above, vibration caused by the beat is transmitted to the vibration sensors 11 via the base part 9, and an analog vibration detection signal is output from each of the vibration sensors 11.

The vibration detection signals output from the respective vibration sensors 11 are each converted into a digital signal by the A/D converter section 2, and parallelly supplied to the CPU 5. When the vibration detection signals are supplied from the respective vibration sensors 11, the percussion pattern-detecting section implemented by the CPU 5 locates a position on the percussion surface part 10, where the beat was applied, based on lags in timing in which the signals were supplied, and generates beat position data indicative of the located position. The work memory 4 has a data storage area allocated for temporarily storing beat position data, and the generated beat position data is stored in the data storage area until new beat position data is generated.

When new beat position data is generated, the percussion pattern-detecting section obtains the difference between the new beat position data and the beat position data stored in the data storage area, to thereby detect the displacement amount of the beat position. Then, after having output a value of the parameter indicative of the detected displacement amount, the percussion pattern-detecting section replaces the beat position data stored in the data storage area with the new beat position data. The electronic percussion instrument according to the present embodiment is similar to the electronic percussion instruments according to the first to third embodiments in that parameter values output from the percussion pattern-detecting section are sequentially stored in the buffer area.

Figure 6:
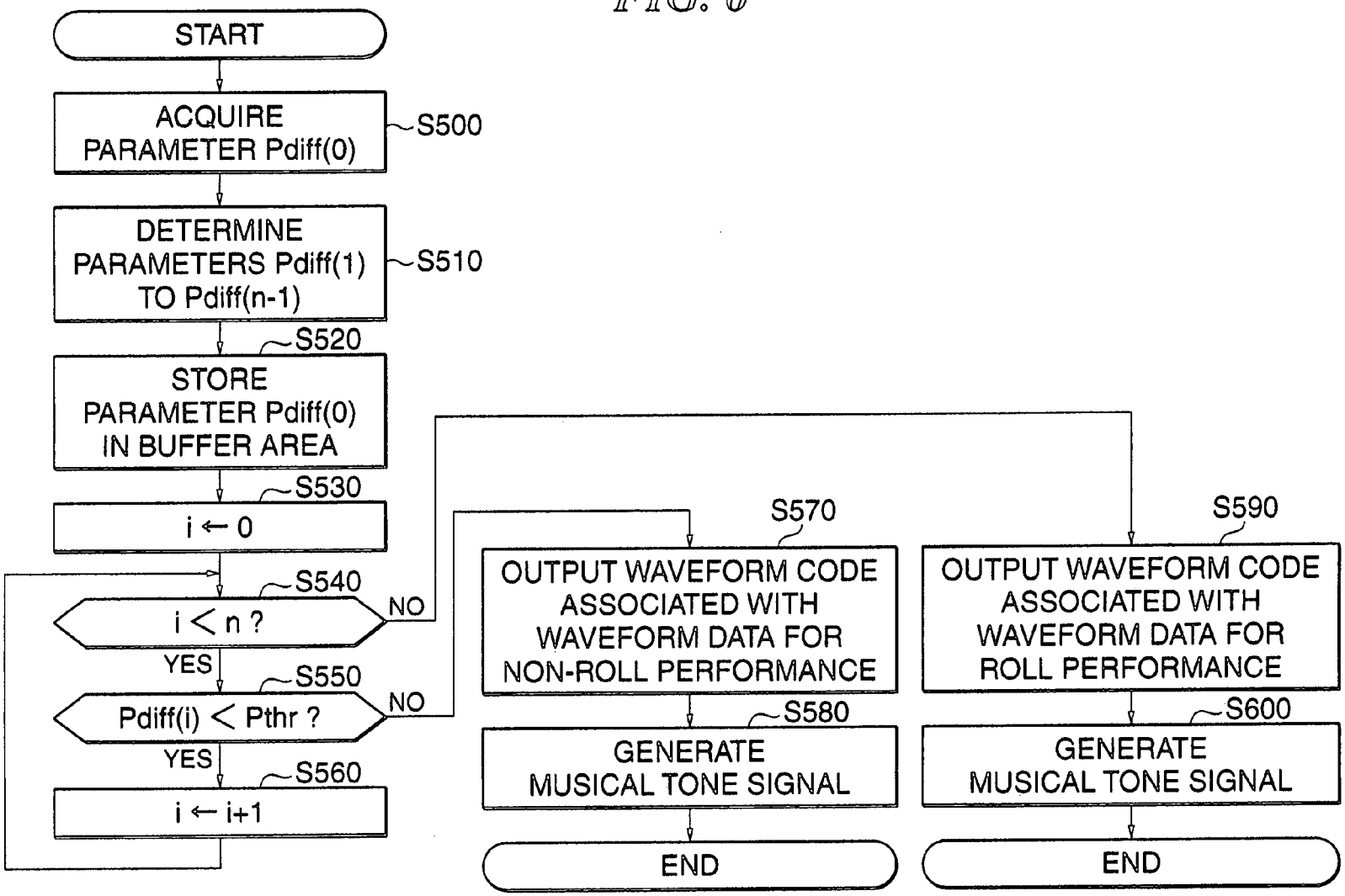
FIG. 6 is a flowchart showing the operation of an electronic percussion instrument according to a fourth embodiment.

FIG. 6 is a flowchart showing the operation of the electronic percussion instrument according to the fourth embodiment.

In FIG. 6, Pdiff represents the parameter indicative of the displacement amount of a beat position, and a suffix (i) attached to the parameter Pdiff is a variable representing a value of the parameter Pdiff. The suffix value corresponds to a position of each parameter Pdiff value in the chronological sequence of the stored values. Further, the constant n represents a predetermined number of times of reference to the parameter Pdiff, and has to be a positive integer not less than 3.

Processing executed in steps S500 to S540 is similar to that in the steps S100 to S140 in FIG. 3 except that the parameter value used for the processing is a parameter value Pdiff(i).

If the answer to the question of the step S540 is affirmative (YES), the process proceeds to a step S550, wherein it is determined whether or not the displacement amount of the beat position represented by the parameter value Pdiff(i) is smaller than a predetermined value Pthr preset as a threshold value. If the answer to the question of the step S550 is affirmative (YES), the process proceeds to a step S560, wherein the value of the variable i is incremented by 1, followed by the process returning to the step S540. On the other hand, if the answer to the question of the step S550 is negative (NO), the processing for non-roll performance is executed (steps S570 and S580).

If the answer to the question of the step S540 is negative (NO), the processing for roll performance is executed (steps S590 and S600).

In the above-described electronic percussion instrument according to the fourth embodiment, values of the parameter Pdiff indicative of the beat position displacement amount are sequentially stored in the buffer area. During this operation, when a beat is applied to the drum pad 1, n parameter Pdiff values, i.e. not less than three parameter Pdiff values including a new parameter Pdiff value obtained from the beat are sequentially referred to in reverse chronological order, and only when the beat position displacement amounts indicated by the respective parameter Pdiff values referred to are smaller than the predetermined displacement amount, a musical tone signal for roll performance is generated. This method also makes it possible to detect percussion by roll performance with high accuracy.

Next, a description will be given of an electronic percussion instrument according to a fifth embodiment of the present invention.

As is distinct from the electronic percussion instruments of the first to fourth embodiments in which whether or not roll performance is being executed is determined based on only one of factors, such as a beat-to-beat time interval, beat intensity, or a beat position displacement amount, which characterizes the pattern of percussion, in the electronic percussion instrument according to the fifth embodiment, whether or not roll performance is being executed is determined by referring to a plurality of factors characterizing the pattern of percussion.

The electronic percussion instrument according to the fifth embodiment is identical in hardware configuration to the electronic percussion instruments according to the first to fourth embodiments. In the electronic percussion instrument according to the fifth embodiment, when a vibration detection signal is supplied from the drum pad 1, the percussion pattern-detecting section implemented by the CPU 5 detects both a beat-to-beat time interval and beat intensity from the vibration detection signal and outputs values of parameters Tdiff and Velo indicative of the detected beat-to-beat time interval and the beat intensity.

Figure 7:
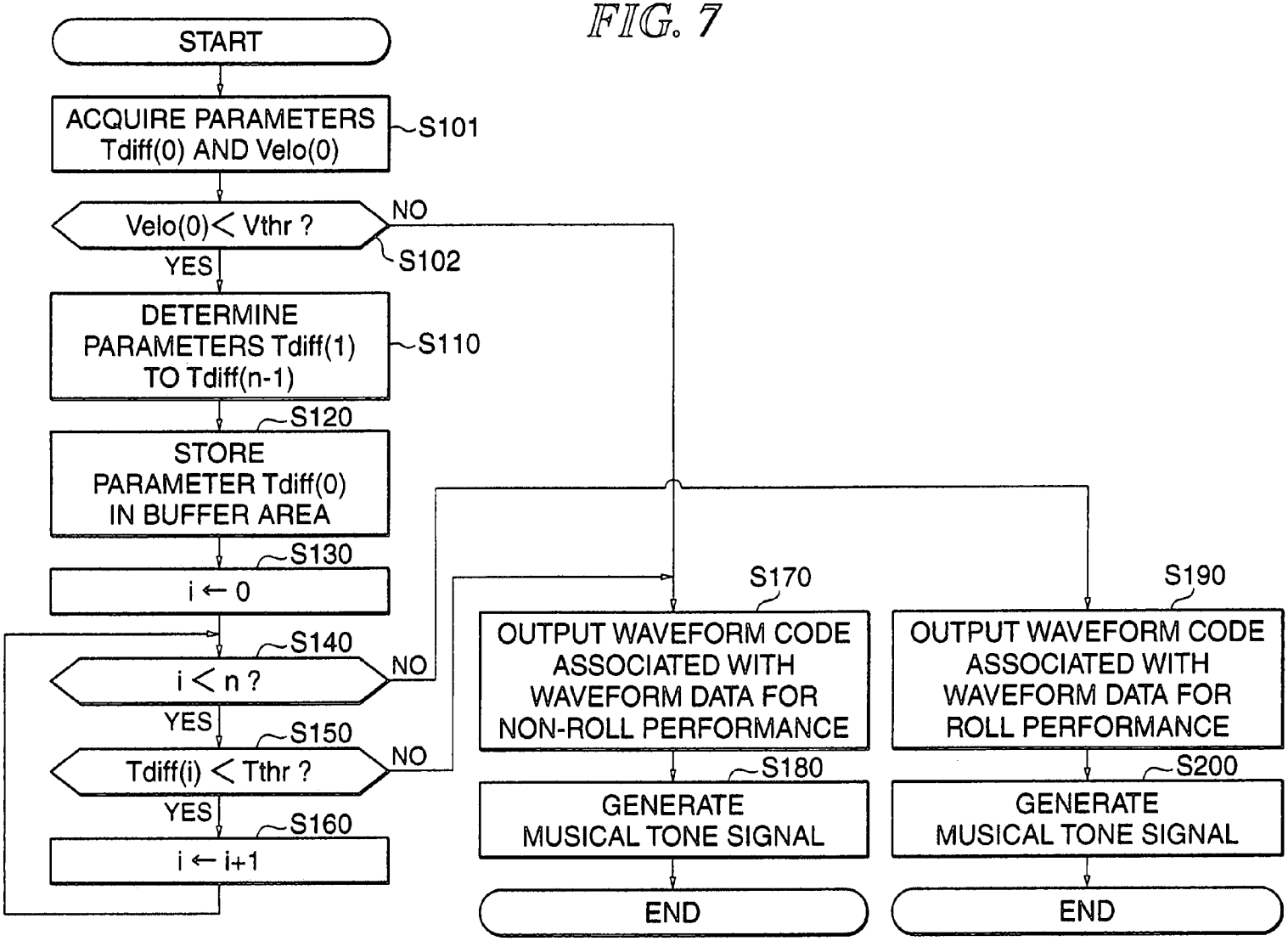
FIG. 7 is a flowchart showing the operation of an electronic percussion instrument according to a fifth embodiment of the present invention.

FIG. 7 is a flowchart showing the operation of the electronic percussion instrument according to the fifth embodiment.

In FIG. 7, Tdiff(i) represents the same as in the flowcharts in FIGS. 3 and 4, and Velo(i) represents the same as in the flowchart in FIG. 5.

In the procedure shown in FIG. 7, the step S100 is replaced by steps S101 and S102. First, in the step S101, new parameter values Tdiff(0) and Velo(0) are acquired from the percussion pattern-detecting section. In the next step S102, it is determined whether or not the beat intensity represented by the parameter value Velo(0) is smaller than the predetermined value Vthr preset as a threshold value. If the answer to the question of the step S102 is affirmative (YES), the same processing as executed in the steps S110 et seq. in FIG. 3 is carried out. On the other hand, if the answer to the question of the step S102 is negative (NO), the program immediately proceeds to a step. S170, wherein the processing for non-roll performance is executed (steps S170 and S180).

In the above-described electronic percussion instrument according to the fifth embodiment, when the parameter value Velo(0) is acquired from the percussion pattern-detecting section, it is determined whether or not the beat intensity indicated by the parameter value Velo(0) indicative thereof is smaller than the predetermined value, and if the beat intensity is not smaller than the predetermined value, the musical tone signal for non-roll performance is generated without referring to beat-to-beat time intervals. Thus, even when a time interval from an immediately preceding beat is short, if the beat intensity higher than the predetermined level is detected, the musical tone signal for non-roll performance is generated, so that a percussion tone closer to that produced by a natural percussion instrument can be electronically produced.

Next, a description will be given of an electronic percussion instrument according to a sixth embodiment of the present invention.

The electronic percussion instrument according to the sixth embodiment is different from the electronic percussion instruments of the first to fifth embodiments in the following points:

Although in the electronic percussion instruments according to the first to fifth embodiments, the waveform memory 6 stores two types of waveform data different in frequency characteristics, in the electronic percussion instrument according to the sixth embodiment, the waveform memory 6 stores a plurality of waveform banks. The waveform banks are formed by sampling waveform data of percussion tones by applying beats different in beat intensity a plurality of times per each degree of beat intensity, and compiling the sampled waveform data into data groups for each substantially equal degree of beat intensity. In short, each of the waveform banks stores a plurality of waveform data analogous to each other in association with beats determined as equal in beat intensity to each other in beat density. Further, waveform bank codes for identifying the respective waveform banks are provided in association with the respective waveform banks, and each of the waveform data forming a waveform bank is assigned a specific number.

Further, although in the electronic percussion instruments according to the first to fifth embodiments, the two functional modules of the percussion pattern-detecting section and the waveform data-determining section are logically realized, in the electronic percussion instrument according to the sixth embodiment, two functional modules of a percussion pattern-determining section and a switching controller are logically realized. Now, a description will be given of the roles of the two functional modules. First, when a beat detection signal is supplied from the vibration sensor 11 of the drum pad 1, the percussion pattern-determining section determines the intensity of the beat applied to the percussion surface part 10, based on the beat detection signal, and generates velocity data according to the determined beat intensity. The switching controller determines a waveform bank corresponding to the beat intensity indicated by the velocity data, and outputs a waveform bank code associated with the identified waveform bank, and a predetermined random numerical value to the tone generation controller 7 together with the velocity data and pad-on data for instructing the tone generation controller 7 to generate a musical tone corresponding to the beat applied to the drum pad 1.

When the waveform bank code, the random numerical value, the velocity data, and the pad-on data are supplied as a set to the tone generation controller 7, the tone generation controller 7 identifies the waveform bank associated with the supplied waveform bank code, from the waveform banks stored in the waveform memory 6. Then, the tone generation controller 7 reads out a waveform code indicated by the supplied random numerical value, from a waveform code group forming the identified waveform bank. Further, the tone generation controller 7 adds envelope waveform data corresponding to the velocity data to the read-out waveform data, to thereby generate a musical tone signal. The audio output section 8 outputs a musical tone synthesized based on this musical tone signal.

Figure 8:
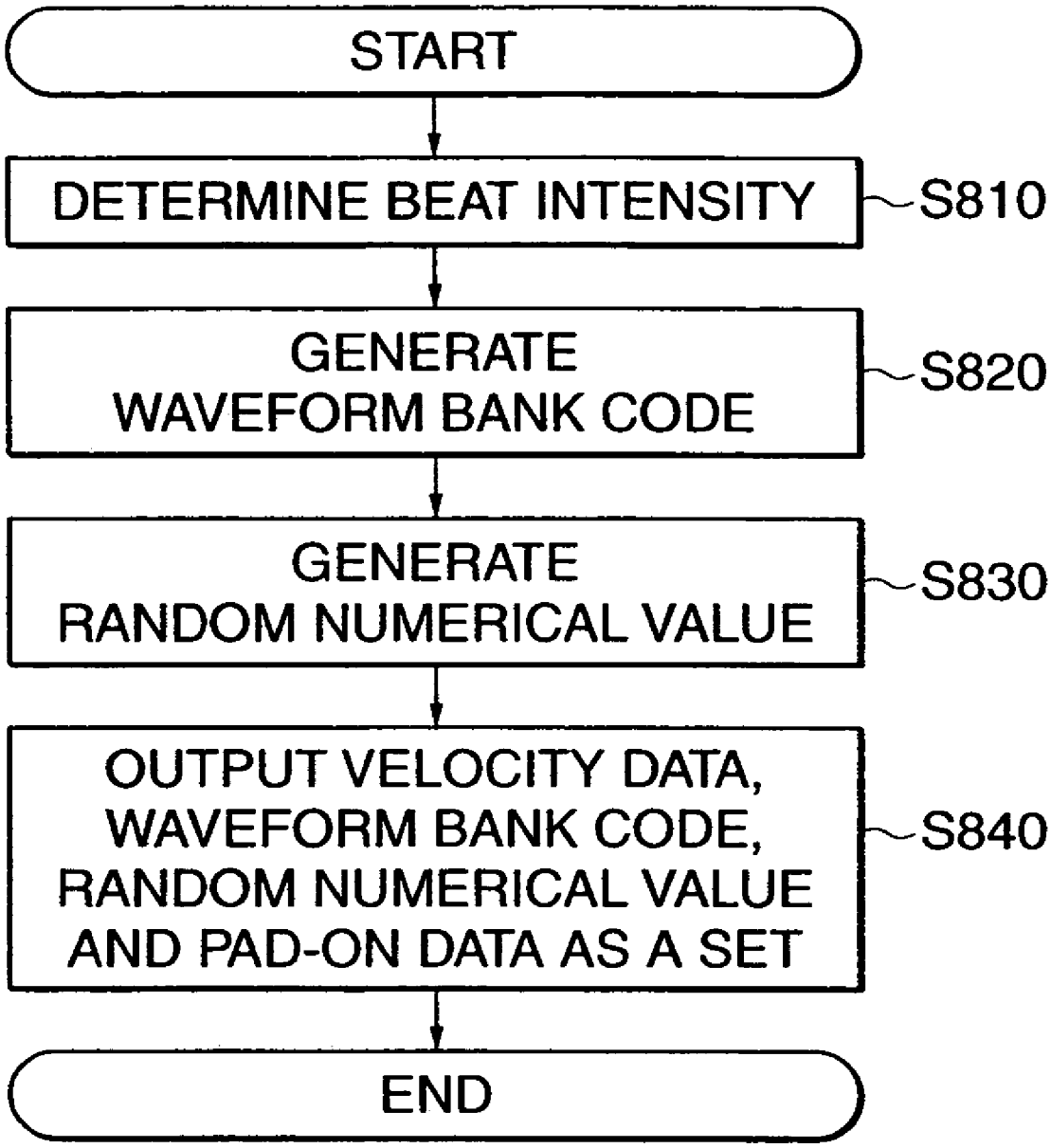
FIG. 8 is a flowchart showing the operation of an electronic percussion instrument according to a sixth embodiment of the present invention.

FIG. 8 is a flowchart showing the operation of the electronic percussion instrument according to the sixth embodiment.

Processing shown in FIG. 8 is started upon being triggered by supply of a beat detection signal from the drum pad 1 to the percussion pattern-determining section. When the beat detection signal is supplied, the percussion pattern-determining section determines beat intensity based on the supplied beat detection signal, and generates velocity data according to the determined beat intensity in a step S810. Then, in a step S820, the switching controller identifies a waveform bank associated with the determined beat intensity, and generates a waveform bank code associated with the identified waveform bank. In the next step S830, a predetermined random numerical value is generated in accordance with a predetermined random number generation algorithm. In a step S840, the velocity data generated in the step S810, the waveform bank code generated in the step S820, the random numerical value generated in the step S830, and the pad-on data are output as a set to the tone generation controller 7. The tone generation controller 7 reads out waveform data indicated by the random numerical value, from the waveform bank associated with the waveform bank code output from the switching controller, and generates a musical tone signal. This sequential processing is repeatedly carried out whenever a new beat detection signal is supplied. More specifically, in the electronic percussion instrument according to the sixth embodiment, whenever a new beat detection signal is output from the vibration sensor 11, the switching controller generates the random numerical value and supplies the same to the tone generation controller 7 to thereby switch waveform data to be read out from the associated waveform bank by the tone generation controller 7.

According to the above-described electronic percussion instrument according to the sixth embodiment, the waveform banks formed by sampling waveform data of percussion tones by applying beats different in beat intensity a plurality of times per each degree of beat intensity, and compiling the sampled waveform data into data groups for each substantially equal degree of beat intensity are stored in the waveform memory 6, and when a beat is applied to the drum pad 1, a musical tone is synthesized using waveform data read out from a waveform bank associated with the beat intensity of the beat. Thus, percussion tones very close to tones obtained when percussion is applied to a natural percussion instrument can be individually produced on a beat intensity-by-beat intensity basis.

Further, waveform data read out from each waveform bank is identified randomly by the random numerical value generated in accordance with the predetermined random number generation algorithm. Therefore, even when beats equal in beat intensity are applied in succession with short strokes, musical tone signals are output which are subtly different from beat to beat without just the same musical tone signal being repeatedly output. Thus, even when beats substantially equal in beat intensity are consecutively applied to the drum pad 1, it is possible to sound percussion tones giving no impression of monotony.

The present invention is not limited to the above-described embodiments, but various changes and modifications can be made.

For example, although in the electronic percussion instruments according to the first to fifth embodiments, the waveform memory 6 stores one type of waveform data for roll performance and one type of waveform data for non-roll performance, the waveform memory 6 may store several types of waveform data for roll performance, which are different in characteristics. In such a variation, when it is determined that percussion for roll performance is applied, one type of waveform data having characteristics closest to the pattern of the applied percussion is selected from the several types of waveform data provided for roll performance, and reproduced.

Further, although each of the electronic percussion instruments according to the first to fifth embodiments is provided with a single drum pad, a plurality of drum pads may be provided. In such a variation, it is necessary to store pairs of waveform data for roll performance and waveform data for non-roll performance, in a number corresponding to the number of the drum pads, in the waveform memory.

A program for realizing the same functions as those of the percussion pattern-detecting section and the waveform data-determining section may be installed on a personal computer provided with an interface for inputting a vibration detection signal and a tone generator for synthesizing musical tones based on musical tone signals, to thereby cause the computer to perform the same operation as performed by each of the electronic percussion instruments according to the first to fifth embodiments.

Further, although in the electronic percussion instruments according to the first to fifth embodiments, two types of waveform data, i.e. the waveform data for roll performance and the waveform data for non-roll performance are stored in advance in the waveform memory 6, and one of the two types of waveform data is selected according to the pattern of percussion applied to the percussion surface part 10 of the drum pad 1, this is not limitative, but only one type of waveform data may be stored in the waveform memory 6, and when roll performance is selected, a musical tone signal obtained from the waveform data may be subjected to an effect-adding process or a filtering process so as to change the tone color.

This variation of the electronic percussion instruments according to the first to fifth embodiments can be defined by a conceptual description of the configuration and operation thereof as follows: "An electronic percussion instrument comprising a waveform data storage device that stores waveform data of percussion tones, a performance operator having a percussion surface, a percussion pattern-detecting device that detects a pattern of percussion applied to the percussion surface of the performance operator, and outputs a value of a parameter indicative of the detected pattern of percussion, a parameter storage device that stores values of the parameter, a storage control device that causes values of the parameter output from the percussion pattern-detecting device to be sequentially stored in the parameter storage device in the order of output, a generation device that is operable when a new value of the parameter is stored in the parameter storage device, to generate a musical tone signal based on waveform data stored in the waveform data storage device, and a processing device that determines, based on the stored new value of the parameter and at least two values of the parameter stored before the new value of the parameter was stored, whether or not the pattern of percussion applied to the percussion surface is for roll performance, and carries out predetermined processing on the generated musical tone signal when the percussion pattern is for roll performance".

Further, although in the electronic percussion instrument according to the sixth embodiment, the waveform banks are formed by sampling waveform data of percussion tones by applying beats different in beat intensity a plurality of times per each degree of beat intensity, and compiling the sampled waveform data into data groups for each substantially equal degree of beat intensity, this is not limitative, but the waveform banks may be formed by compiling a plurality of sampled waveform data into data groups for each degree of another factor than the beat intensity, which characterizes the pattern of percussion.

For example, waveform data of percussion tones may be sampled by applying beats different in beat position a plurality of times per each beat position, and compiled into data groups for each substantially identical beat position, to form the waveform banks. In the variation in which the waveform banks are thus configured, when a beat detection signal is supplied from the drum pad 1, the percussion pattern-determining section detects a parameter indicative of a beat position from the signal, and determines a waveform bank to be selected from the waveform memory 6, based on the detected parameter. Similarly, waveform data of percussion tones may be sampled by applying beats different in beat-to-beat interval a plurality of times per each beat-to-beat interval, and compiled into data groups for each substantially equal beat-to-beat interval, to form the waveform banks, or alternatively, waveform data of percussion tones may be sampled by applying beats different in percussion surface contact time period a plurality of times per each percussion surface contact time period, and compiled into data groups for each substantially equal percussion surface contact time period, to form the waveform banks.

Furthermore, waveform data of percussion tones may be compiled based on a combination of a plurality of factors, such as beat intensity and a beat position, characterizing the pattern of percussion, to form the waveform banks in multi-dimensional matrix form. In this type of variation, the percussion pattern-determining section detects a plurality of parameters e.g. indicative of the beat intensity and the beat position, from the beat detection signal, and determines a waveform bank to be selected from the waveform memory 6, based on a combination of percussion patterns indicated by the detected parameters.

Although in the electronic percussion instrument according to the sixth embodiment, whenever the beat detection signal is supplied, a random numerical value is generated, and waveform data indicated by the generated random numerical value is read out from a waveform bank, this is not limitative but a method may be employed in which numbers assigned to respective waveform data forming the waveform banks are stored in association with a sequence of data reading operations to be carried out such that as the beat detection signal is supplied, waveform data are sequentially read out. This type of variation also makes it possible to avoid repeated output of the same musical tone, thereby sounding percussion tones giving no impression of monotony.

A program for realizing the same functions as those of the percussion pattern-determining section and the switching controller may be installed on a personal computer provided with an interface for inputting beat detection signals and a tone generator for synthesizing musical tones based on musical tone signals, to thereby cause the computer to perform the same operation as that of the electronic percussion instrument according to the sixth embodiment.

This variation of the electronic percussion instrument according to the sixth embodiment can be defined by a conceptual description of the configuration and operation thereof as follows: "An electronic percussion instrument comprising a storage device that stores a plurality of waveform data obtained by applying percussion to a percussion instrument, and stores a plurality of waveform data analogous to each other in association with beats determined as equal to each other, a performance operator that has a percussion surface, a detecting device that detects a beat applied to the percussion surface of the performance operator, and outputs a beat detection signal indicative of the detected beat, a determining device that determines a pattern of percussion based on the beat detection signal, a waveform reading device that reads out waveform data associated with the pattern determined by the determining device, from the storage device, and is operable when percussion of a certain pattern is detected, to read out waveform data selected in accordance with a predetermined algorithm from a plurality of waveform data associated with beats equal to each other, corresponding to the detected pattern, a musical tone-generating device that generates a musical tone signal based on the read-out waveform data, and outputs the generated musical tone signal, and a switching control device that switches waveform data to be read out by the waveform reading device whenever the beat detection signal is output."

It is to be understood that the object of the present invention may also be accomplished by supplying a computer or a CPU with a program code of software, which realizes the functions of any of the above described embodiments, and causing the computer or CPU to read out and execute the program code.

The above program has only to realize the functions of either of the above described embodiments on a computer, and the form of the program may be an object code, a program code executed by an interpreter, or script data supplied to an OS.

Further, it is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and therefore the program code and the storage medium in which the program code is stored constitute the present invention.

Examples of the storage medium for supplying the program code include a floppy (registered trademark) disk, a hard disk, a magnetic-optical disk, a CD–ROM, a CD–R, a CD–RW, a DVD–ROM, a DVD–RAM, a DVD–RW, a DVD+RW, a magnetic tape, a nonvolatile memory card, and a ROM. Alternatively, the program may be downloaded from another computer, a database, or the like, not shown, connected to the Internet, a commercial network, a local area network, or the like.

Further, it is to be understood that the functions of any of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An electronic percussion instrument comprising:

a waveform data storage device that stores waveform data of percussion tones to be output for roll performance and waveform data of percussion tones to be output for non-roll performance;

a performance operator that has a percussion surface;

a percussion pattern-detecting device that detects a pattern of percussion applied to the percussion surface of said performance operator, and outputs a value of a parameter indicative of the detected pattern of percussion;

a parameter storage device that stores values of the parameter;

a storage control device that causes values of the parameter output from said percussion pattern-detecting device to be sequentially stored in said parameter storage device in an order of output;

a waveform data-determining device that is operable when a new value of the parameter is stored in said parameter storage device, to determine one of the two waveform data stored in said waveform data storage device according to at least two values of the parameter stored before the new value of the parameter was stored and the new value of the parameter; and a musical tone signal output device that reads out the determined waveform data from said waveform data storage device, and outputs a musical tone signal generated based on the read-out waveform data.

2. An electronic percussion instrument as claimed in claim 1, wherein the detected pattern of percussion is a beat-to-beat time interval, a degree of beat intensity, a displacement amount of a beat position on the percussion surface, or a combination of at least two thereof.

3. An electronic percussion instrument as claimed in claim 1, wherein said percussion pattern-detecting device is operable when a beat is applied to the percussion surface, to detect a time interval between the beat and an immediately preceding beat as the pattern of percussion, and output a value of a parameter indicative of the detected time interval as the value of the parameter, and said waveform data-determining device is operable when a time interval indicated by a new value of the parameter stored in said parameter storage device and time intervals indicated by at least two values of the parameter stored before the new value of the parameter was stored are all shorter than a predetermined value, to determine the waveform data of percussion tones to be output for roll performance, from the two waveform data stored in said waveform data storage device.

4. An electronic percussion instrument as claimed in claim 3, wherein said percussion pattern-detecting device detects beat intensity of the beat applied to the percussion surface and the time interval, and outputs values of respective parameters indicative of the detected beat intensity and the detected time interval, and said waveform data-determining device is operable when the time interval indicated by the new value of the parameter indicative thereof stored in said parameter storage device and the time intervals indicated by the at least two values of the parameter indicative thereof stored before the new value of the parameter indicative thereof was stored are all shorter than the predetermined value, and a degree of beat intensity indicated by a new value of the parameter indicative thereof is smaller than a predetermined value, to determine the waveform data of percussion tones to be output for roll performance.

5. An electronic percussion instrument as claimed in claim 1, wherein said percussion pattern-detecting device is operable when a beat is applied to the percussion surface, to detect a time interval between the beat and an immediately preceding beat as the pattern of percussion, and output a value of a parameter indicative of the detected time interval as the value of the parameter, and said waveform data-determining device is operable when an average value of the time interval indicated by a new value of the parameter indicative thereof stored in said parameter storage device and time intervals indicated by at least two values of the parameter indicative thereof stored before the new value of the parameter indicative thereof was stored is smaller than a predetermined value, to determine the waveform data of percussion tones to be output for roll performance, from the two waveform data stored in said waveform data storage device.

6. An electronic percussion instrument as claimed in claim 5, wherein said percussion pattern-detecting device detects beat intensity of the beat applied to the percussion surface and the time interval, and outputs values of respective parameters indicative of the detected beat intensity and the detected time interval, and said waveform data-determining device is operable when the average value of the time interval indicated by the new value of the parameter indicative thereof stored in said parameter storage device and the time intervals indicated by the at least two values of the parameter indicative thereof stored before the new value of the parameter was stored is smaller than the predetermined value and a degree of beat intensity indicated by a new value of the parameter indicative thereof is smaller than a predetermined value, to determine the waveform data of percussion tones to be output for roll performance.

7. An electronic percussion instrument as claimed in claim 1, wherein said percussion pattern-detecting device is operable when a beat is applied to the percussion surface, to detect beat intensity of the beat as the pattern of percussion, and output a value of a parameter indicative of the detected beat intensity as the value of the parameter, and said waveform data-determining device is operable when a degree of beat intensity indicated by a new value of the parameter indicative thereof stored in said parameter storage device and degrees of beat intensity indicated by the at least two values of the parameter indicative thereof stored before the new value of the parameter indicative thereof was stored are all smaller than a predetermined value, to determine the waveform data of percussion tones to be output for roll performance, from the two waveform data stored in said waveform data storage device.

8. An electronic percussion instrument as claimed in claim 1, wherein said percussion pattern-detecting device is operable when a beat is applied to the percussion surface, to detect a positional displacement amount between a position where the beat was applied and a position where an immediately preceding beat was applied, as the pattern of percussion, and output a parameter indicative of the detected positional displacement amount, and said waveform data-determining device is operable when a positional displacement amount indicated by a new value of the parameter indicative thereof stored in said parameter storage device and positional displacement amounts indicated by at least two values of the parameter indicative thereof stored before the new value of the parameter indicative thereof was stored are all smaller than a predetermined value, to determine the waveform data of percussion tones to be output for roll performance, from the two waveform data stored in said waveform data storage device.

9. An electronic percussion instrument comprising:

a storage device that stores a plurality of waveform data obtained by applying percussion to a percussion instrument, and stores a plurality of waveform data analogous to each other in association with beats determined as equal to each other;

a performance operator that has a percussion surface;

a detecting device that detects a beat applied to the percussion surface of said performance operator, and outputs a beat detection signal indicative of the detected beat;

a determining device that determines a pattern of percussion based on the beat detection signal;

a waveform reading device that reads out waveform data associated with the pattern determined by said determining device, from the storage device, said waveform reading device being operable when percussion of a certain pattern is detected, to read out waveform data selected in accordance with a predetermined algorithm from a plurality of waveform data associated with beats equal to each other, corresponding to the detected pattern;

a musical tone-generating device that generates a musical tone signal based on the read-out waveform data, and outputs the generated musical tone signal; and a switching control device that switches waveform data to be read out by said waveform reading device whenever the beat detection-signal is output.

10. An electronic percussion instrument as claimed in claim 9, wherein the detected pattern of percussion is beat intensity, a beat-to-beat time interval, a beat position on the percussion surface, a time period of contact with the percussion surface, or a combination of at least two thereof.

11. An electronic percussion instrument as claimed in claim 9, wherein said switching control device generates a random number in accordance with a predetermined random number generation algorithm, and switches the waveform data to be read out by said waveform reading device, according to the generated random number.

12. A program, on a computer readable medium, readable by a computer including a waveform data storage device that stores waveform data of percussion tones to be output for roll performance and waveform data of percussion tones to be output for non-roll performance, an input device that inputs a parameter indicative of a pattern of percussion applied to a percussion instrument, a parameter storage device that stores values of the parameter, and an output device that outputs a musical tone signal, comprising the instructions for:

causing values of the parameter input via the input device to be sequentially stored in the parameter storage device in an order of input;

when a new value of the parameter is stored in the parameter storage device, determining one of the two waveform data stored in the waveform data storage device according to at least two values of the parameter stored before the new value of the parameter was stored and the new value of the parameter; and reading out the determined waveform data from the waveform data storage device, and outputting a musical tone signal generated based on the read-out waveform data.

13. A program, on a computer readable medium, readable by a computer including a storage device that stores a plurality of waveform data obtained by applying percussion to a percussion instrument, and stores a plurality of waveform data analogous to each other in association with beats determined as equal to each other, an input device that inputs a beat detection signal indicative of a beat applied to a percussion instrument, and an output device that outputs a musical tone signal, comprising the instructions for:

determining a pattern of percussion based on the beat detection signal input via the input device;

reading out waveform data associated with the pattern determined by said determining, from the storage device, said waveform reading being operable when percussion of a certain pattern is detected, to read out waveform data selected in accordance with a predetermined algorithm from a plurality of waveform data associated with beats equal to each other, corresponding to the detected pattern;

generating the musical tone signal based on the read-out waveform data, and outputs the generated musical tone signal via the output device; and switching waveform data to be read out by said waveform reading whenever the beat detection signal is output.

* * * * *